United States Patent [19]

Burge

[11] 4,084,636

[45] Apr. 18, 1978

[54] HYDRAULIC JUNK RETRIEVER

[76] Inventor: Edward V. Burge, 14800 Memorial, Apt. 241, Houston, Tex. 77079

[21] Appl. No.: 717,981

[22] Filed: Aug. 26, 1976

[51] Int. Cl.[2] ..... E21B 31/06

[52] U.S. Cl. ..... 166/65 M; 166/99; 175/107

[58] Field of Search ..... 166/65 M, 99, 69, 162, 166/223; 294/86.11; 175/368, 312, 107, 231, 319, 65; 415/502; 299/17

[56] References Cited

U.S. PATENT DOCUMENTS

| | | | |
|---|---|---|---|
| 142,992 | 9/1873 | Cross | 415/502 |
| 2,556,849 | 6/1951 | Nolley et al. | 166/65 M |
| 2,729,494 | 1/1956 | Trowbridge | 166/65 M |
| 2,753,154 | 7/1956 | Gaut | 175/107 |
| 2,778,669 | 1/1957 | Goodwin | 166/65 M |
| 2,830,663 | 4/1958 | Kirby | 166/65 M |
| 3,382,925 | 5/1968 | Jennings | 166/99 |

*Primary Examiner*—Ernest R. Purcer
*Assistant Examiner*—William F. Pate, III
*Attorney, Agent, or Firm*—Joseph H. Schley; Thomas L. Cantrell

[57] ABSTRACT

A hydraulic junk retriever having a tubular mandrel for connection and communication with a drill pipe and rotatably suspending an elongate cylindrical housing within a well bore. A flow passage in the upper end of the housing communicates with bore of the mandrel and has one or more ports extending outwardly at a tangent to the cylindrical interior of the passage for discharging or jetting drilling fluid under pressure tangentially into the well bore so as to impart rotation to said housing and centrifugal force to the drilling fluid. Preferably, the tangential discharge ports are downwardly inclined whereby the circular motion of the fluid becomes helical so as to direct said fluid to the bottom of the well bore at which the lower end of the housing is disposed. A downwardly opening barrel is provided by the lower portion of the housing for receiving the swirling fluid from the well bore bottom and has its upper end communicating with said well bore to permit upward reverse circulation of said fluid through the barrel which has means above its lower end to trap large debris therein. The barrel has cutting teeth at its lower end to loosen debris embedded in the well bore bottom, annular magnets within said barrel for attracting ferromagnetic debris, and means within the upper end of said barrel for screening the upward reverse circulation of fluid. Internal upright vanes are provided in the lower end portion of the barrel for creating a vortex therein upon the aforesaid rotation of the housing so as to draw debris into said barrel from the well bore bottom, and the cutting teeth may form the lower extremities of the vanes. It is noted that the modulus of the vortex increases with the pressure of the drilling fluid, which also increases the speed of rotation of the housing.

9 Claims, 7 Drawing Figures

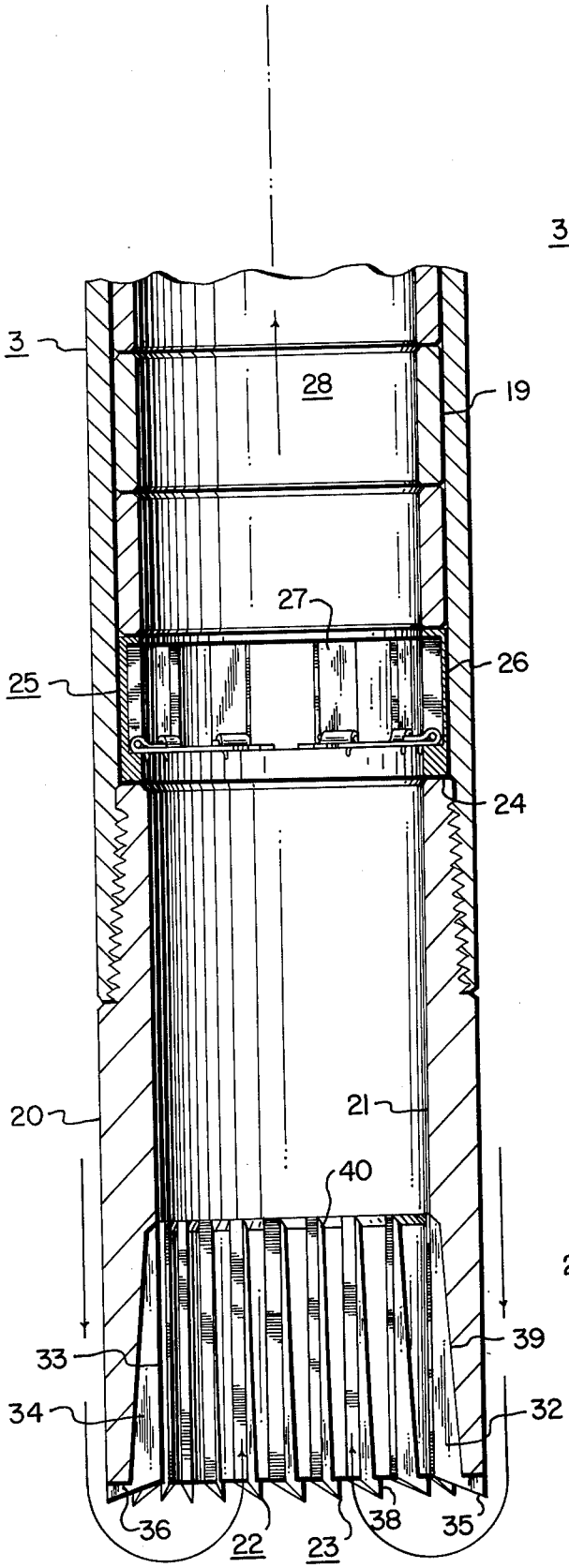
FIG. 3
FIG. 4
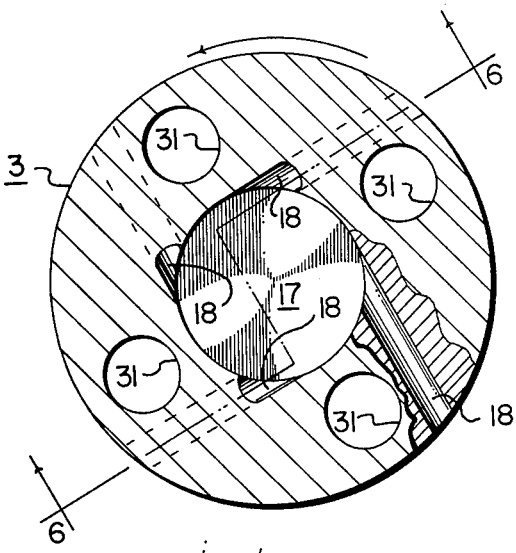
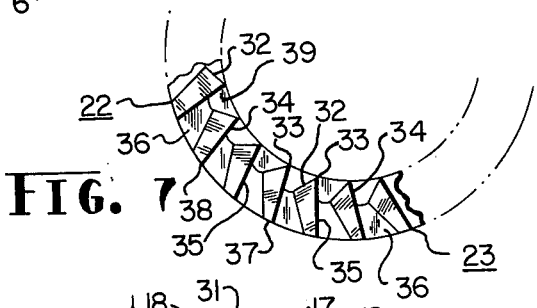
FIG. 7
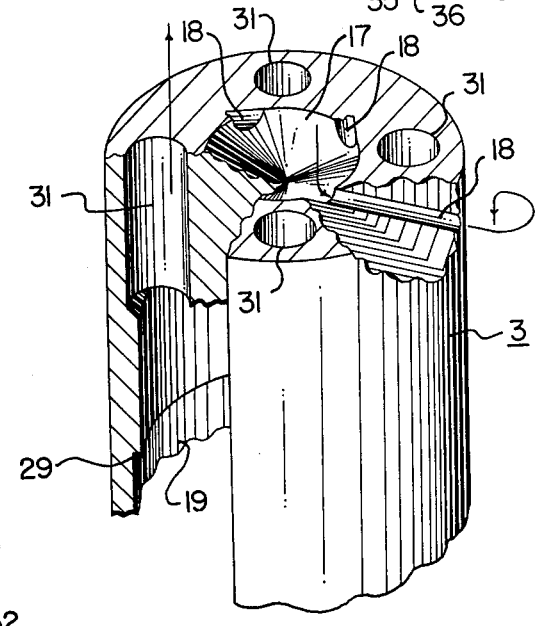
FIG. 5

HYDRAULIC JUNK RETRIEVER

SUMMARY OF THE INVENTION

It is well known in the art of retrieving metallic parts from well bores to employ junk baskets having cages for retaining junk, teeth at the lower ends of the baskets for cutting the formation upon rotation of the drill pipe supporting said baskets, reverse circulation of drilling fluid downwardly and exteriorly of said junk baskets and then upwardly through the interiors of said baskets for directing junk thereinto, and magnets for attracting into said baskets ferromagnetic articles, such as steel bits, cones, cutters and bearings.

In the present invention, all of the foregoing are utilized in addition to (1) rotation of the barrel or housing of a hydraulic junk retriever independently of a drill pipe from which it is rotatably suspended within a well bore, (2) downward helical or swirling movement of drilling fluid in the annulus between the junk retriever and well bore, and (3) the creation of a vortex at the bottom of said well bore and within the downwardly opening lower portion of said retriever barrel or housing for drawing debris thereinto.

The junk retriever of this invention has an elongate cylindrical housing rotatably suspended from a tubular mandrel secured to the lower end of a drill pipe communicating therewith. A flow passage in the upper end of the housing communicates with the bore of the mandrel and has one or more ports extending outwardly and, preferably, downwardly from its lower portion at a tangent to the cylindrical interior of the passage for discharging drilling fluid under pressure tangentially into a well bore so as to impart centrifugal force to the fluid as well as rotation to said housing. A downwardly opening barrel in the lower portion of the housing is adapted to receive the swirling drilling fluid from the bottom of the well bore and has internal upright vanes for creating a vortex upon rotation of said housing so as to draw debris into the barrel. Cutter teeth are provided on the lower extremity of the barrel for rotation with the retriever housing to cut the formation and loosen debris embedded in the well bore bottom and this loosening is assisted by the impingement of the fluid against said bottom. Reverse circulation downwardly around the housing and upwardly through its barrel is accommodated by openings in the upper end of said barrel communicating with the well bore. A cage, having spring-pressed fingers, is disposed within the lower portion of the barrel so as to permit upward travel of large pieces of junk with the fluid, the fingers being pivoted upwardly by said junk and then swinging downwardly to trap said junk. Annular magnets may be mounted in the barrel above the cage for attracting ferromagnetic debris and screen means may be disposed thereabove for preventing the escape of any debris which might tend to clog or interfere with communication between the upper end of said barrel and the well bore. Manifestly, the pressure of the drilling fluid controls the speed of rotation of the housing as well as the velocity of the vortex and the downward swirling of the fluid adds impetus to said vortex. It is believed to be readily apparent that the dimensions, configuration and/or contour as well as the angular relation of the vanes to the axis of rotation of the retriever housing or barrel are subject to variation in order to provide optimum efficiency.

BRIEF DESCRIPTIONS OF THE DRAWINGS

FIG. 1 is a side elevational view of a hydraulic junk retriever constructed in accordance with the invention, FIG. 2 is a transverse vertical sectional view, on an enlarged scale, of the upper portion of the junk retriever illustrating the rotatable connection of its housing to its mandrel (shown in elevation) and the reverse circulation path of drilling fluid around and through said retriever, FIG. 3 is a view similar to FIG. 2 of the lower portion of said junk retriever and its housing and showing the reverse circulation of the drilling fluid, FIG. 4 is a horizontal cross-sectional view taken on the line 4—4 of FIG. 2 to illustrate the tangential discharge ports and the upright escape passages at the upper end of said retriever housing, FIG. 5 is a perspective view, partly in section, of said housing upper end showing the downward outward inclination of said tangential discharge ports, FIG. 6 is a transverse vertical sectional view taken on the line 6—6 of FIG. 4 through one of said discharge ports, and FIG. 7 is a bottom plan view of a portion of the milling cutter showing the configuration of its teeth and their relationship.

DESCRIPTION OF A PREFERRED EMBODIMENT OF THE INVENTION

Figure 1:
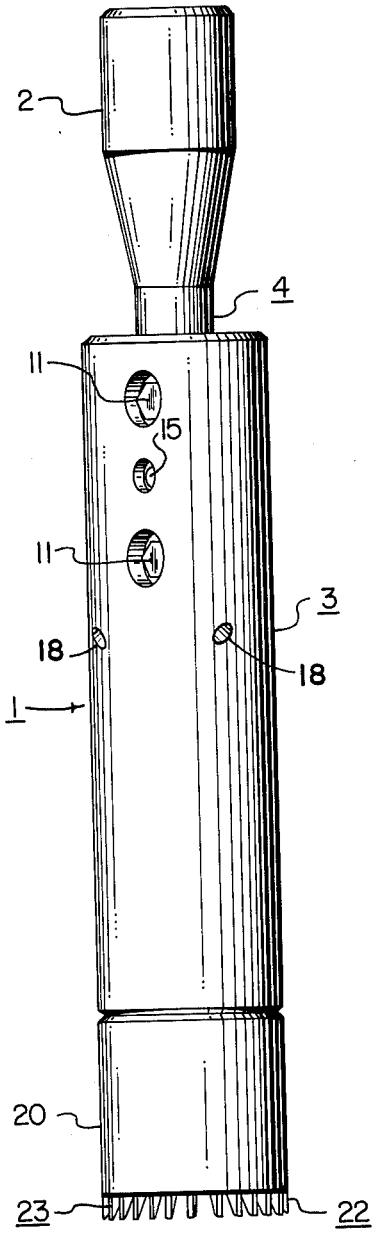

In the drawings, the numeral 1 designates a junk retriever embodying the principles of the invention and comprising a tubular mandrel 2, adapted to be secured to and communicating with the lower end of a tubular drill stem or pipr (not shown) for lowering therewith into a well bore, and an elongate cylindrical housing 3 rotatably suspended from the mandrel. As shown at 4 in FIG. 2, the lower portion of the tubular mandrel 2 is reduced in external diameter to provide an elongate depending tubular pin or spindle 4 for rotatable confinement within an axial complementary cylindrical bore or socket 5 in the upper end portion of the housing 3. The mandrel spindle 4 and housing socket 5 are of sufficient length to accommodate, between the cylindrical surfaces thereof, a pair of spaced upper and lower annular ball bearing races 6 which are formed by coacting annular grooves or recesses 7, 8 in said respective surfaces, the grooves being arcuate in cross-section. A multiplicity of ball bearings 9 is confined in each race 6 and is adapted to be inserted thereinto through radial screwthreaded openings 10 in the wall of the housing. These openings may be closed by suitable plugs or screws 11 having their enlarged polygonal heads recessed in the exterior of the housing 3. One or more sealing or O-rings 12 are recessed in the housing socket above the upper and below the lower ball bearing races for confining a lubricant which is adapted to be inserted into an annular groove 13 in said socket between said races through a radial screwthreaded opening 14 in the wall of said housing and closed by a suitable plug or screw 15 having its enlarged recessed head recessed in the housing exterior.

Figure 2:
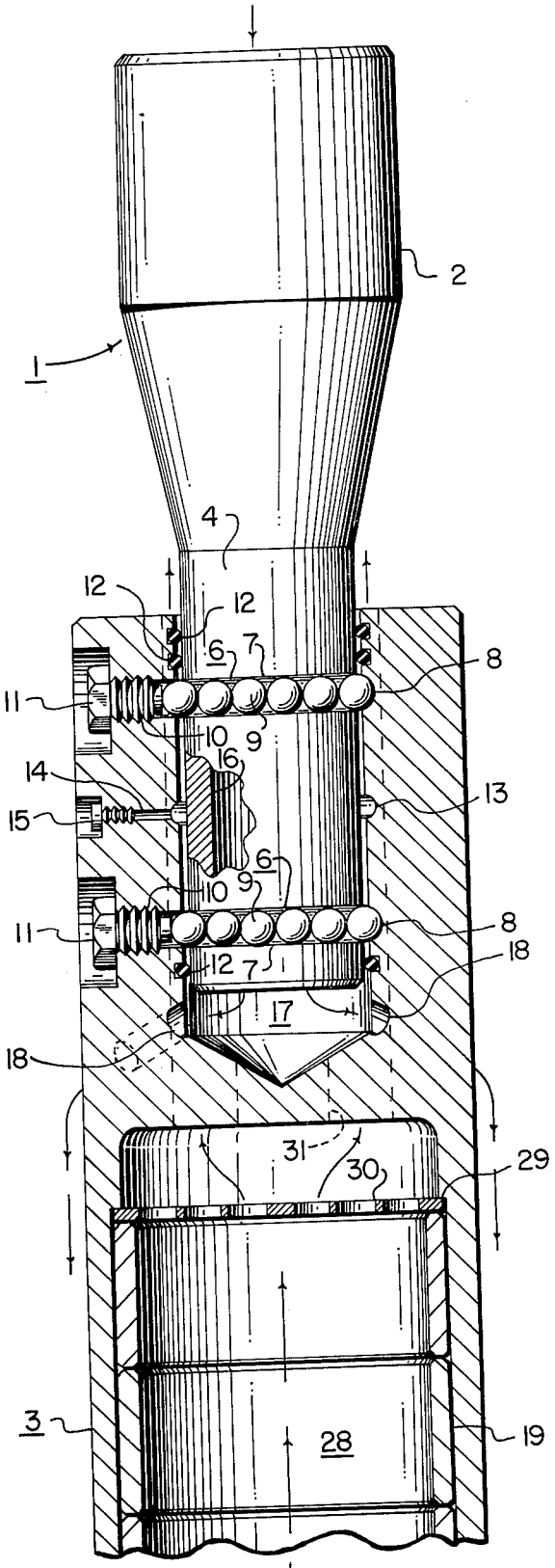

As shown at 16 in FIG. 2, the lower end of the axial bore of the mandrel 2 at the lower end of its depending spindle 4 communicates with the lower end of the socket 5 of the housing, and said spindle lower end is spaced from said socket lower end to provide an axial cylindrical chamber 17 in the upper end portion of said housing. One or more, preferably four, ports 18 (FIGS.

4, 5, 6) extend outwardly from the chamber 17 through the wall of the housing 3 at a tangent to the cylindrical exterior thereof for discharging drilling fluid, supplied to said chamber through the mandrel bore 16 by the drill pipe, tangentially into a well bore so as to impart rotation to said housing and centrifugal force to the discharged drilling fluid. Preferably, the ports 18 are inclined downwardly outward whereby the path of the fluid discharged into the well bore is helical so as to direct said fluid to the lower end of the cylindrical housing exteriorly thereof. The major portion of the housing 3 is disposed below the ports (FIGS. 2, 3) and is tubular so as to provide an axial downwardly opening cylindrical barrel or chamber 19 of relatively large diameter and appreciable length for receiving the upward flow of the discharged fluid from the bottom of the well bore. Preferably, a tubular housing extension or short sleeve 20 (FIG. 3) is screwthreaded into the lower end of the housing so as to facilitate its detachment and has its coextensive cylindrical bore 21 communicating with and forming a continuation of the barrel 19.

For cutting the formation at the bottom of the well bore upon rotation of the housing 3 so as to loosen debris embedded therein, an integral circular milling cutter 22 (FIG. 3) is provided at the open bottom of the cylindrical wall of the sleeve 20 and has equally spaced teeth 23 which, preferably, are hard surfaced. In addition to permitting removal of the milling cutter 22 for sharpening or replacement, the upper end of the housing extension or sleeve provides an upset annular shoulder 24 within the barrel 19 for supporting a more or less conventional trap 25 by its annular mounting frame or collar 26. Spring-pressed fingers 27 are pivotally attached to and extend transversely inward from the base of the collar 26 for closing the lower portion of the barrel. The inner periphery of the collar is recessed to accommodate the fingers 27 when swung upwardly and outwardly to erect position by large debris, such as the cones of rotary drill bits, passing upwardly through the trap 25.

Figure 6:
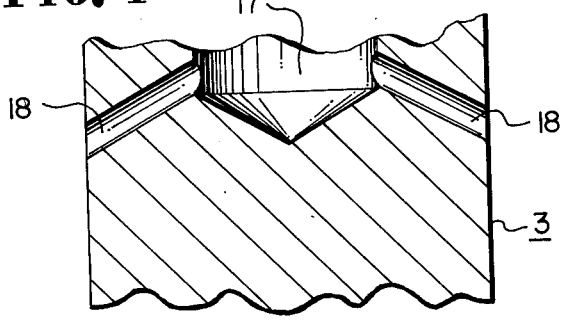

Above the trap, a plurality of annular magnets 28 of the permanent type is stacked within the barrel 19 to attract debris of ferromagnetic metal, and the external diameter of each magnet is substantially equal to the internal diameter of said barrel for complementary engagement therewith. Preferably, these magnets extend throughout the length of the barrel above the trap and terminate shortly below the upper end portion of said barrel which is of reduced diameter (FIG. 2) to provide an annular downwardly facing shoulder 29. It is pointed out that the internal diameters of the magnets 28, the trap 25 and the sleeve 20 (bore 21) are substantially equal so as to provide an internal circumferential surface of substantially constant diameter within the barrel 19. A perforated circular plate or disk 30 is confined between the shoulder 29 and the uppermost magnet for screening the upward reverse circulation of the drilling fluid through the barrel. The upper end of the barrel 19 communicates with the well bore through a plurality of upright passages or openings 31 in the upper end of the housing 3 (FIGS. 4, 5, 6) and interposed between the inclined tangential discharge ports 18 and outwardly of the axial socket 5 and mandrel 2.

Each elongate cutter tooth 23 (FIGS. 3, 7) has an internal coextensively relatively sharp or cutting edge 33 at its inner upright margin formed by the acute convergence of the inner margins of its inner lateral surfaces or sides 32, 34. The lateral tooth surface 34 may extend at an angle of about (12½°) to the radius of the circular milling cutter 22. A transverse downwardly facing relatively sharp or acute cutting edge 35 is provided by bevelling the lower or outer end surfaces of each tooth which project below the lower extremity of the barrel extension of sleeve 20 as shown by the recesses 36 at the outer perimeter of the latter. Also, the leading side 34 of each tooth 23 converges at an acute angle with its outer surface 37 to provide an external cutting edge 38.

As shown by the numeral 39 in FIG. 3, elongated equally spaced grooves or recesses extend axially upwardly from between the teeth 23 in the bore 21 or the interior of the cylindrical wall of the sleeve 20 to provide internal upright recessed fin-like blades or vanes 40 for creating a vortex within the barrel 19 upon rotation of the housing 3 so as to draw or suck debris into said barrel from said well bore bottom. Preferably, the grooves 39 taper radially upward and inward so as to permit maximum radial depth or width of the lower portions of the elongated vanes 40 without undue weakening of the barrel extension and its teeth. The latter are aligned with and, as shown in FIGS. 3, 7, may form the lower extremities of the vanes. Since the teeth and vanes are formed in the wall of the barrel, the inner margins thereof are flush with the wall of the bore 21. It is noted that the vanes 40 are subject to variation in length, width, depth, configuration and/or contour as well as angular relation to the axis of rotation of the housing and its barrel so as to provide maximum efficiency. Since the sleeve 20 is detachably connected to the housing 3, said sleeve may be replaced due to wear of the vanes and/or teeth 23 or to substitute different types of vanes.

In operation, the drilling fluid flows from the bore 16 of the mandrel into the chamber 17 at the lower end of the housing socket and jets tangentially outward and downward through the discharge ports 18 to the housing exterior as shown by the arrows in FIG. 2. Velocity is imparted to the jetted fluid by the combined area of the ports 18 being less than the diameter of the chamber 17 so as to restrict the flow of said fluid from said chamber. Due to the tangential discharge of this fluid, the housing 3 is rotated relative to the tubular spindle 4 of mandrel 2 so as to increase the velocity of said fluid. The inclination of the ports directs the discharged fluid downwardly in a helical or swirling path to the milling cutter 22 at the lower end of the housing exterior as shown by the arrows in FIG. 3. Since the milling cutter is adjacent or in engagement with the bottom of the well bore, the drilling fluid is deflected upwardly around said cutter into the bore 21 of the barrel extension or sleeve 20. The vanes 40 create a vortex at the well bore bottom and within the lower portion of the sleeve bore whereby loosened formation and other debris, such as parts of drill bits or other well tools, are drawn or sucked upwardly into the barrel 19 past the trap 25.

The spring-pressed fingers 27 of the trap are pivoted upwardly by the upward travel of relatively large debris with the fluid, and then said fingers return to their lower horizontal position so as to support and prevent downward escape of said debris. Of course, the screen plate 30 (FIG. 2) arrests further upward travel of such debris, while permitting the escape of the fluid and relatively small debris from the upper end of the barrel through the upright passages 31 which may be of larger diameter than the openings of said plate so as to prevent clogging of said passages. At periodic intervals and/or when the resistance of the flow of the fluid increases sufficiently, it is desirable or necessary to remove the junk retriever by withdrawing the drill stem for cleaning or replacing said retriever. Since the barrel extension or sleeve 20 is readily removable due to its screwthreaded connection to the housing, the trap is likewise removable to permit emptying of the barrel 19 and said sleeve may be replaced if necessary or desirable.

Attention is directed to the fact that the pressure of the drilling fluid controls the speed of rotation of the housing 3 as well as the vanes 40 of its sleeve and the vortex created by the rotation of said vanes. For example, approximately (600) revolutions per minute of the retriever housing and its vanes is provided when the pressure of the drilling fluid is about (1400) psig. Consequently, the RPMs may be varied by variating the psig.

The foregoing description of the invention is explanatory thereof and various changes in the size, shape and materials, as well as in the details of the illustrated construction may be made, within the scope of the appended claims, without departing from the spirit of the invention.

I claim:

1. A hydraulic junk retriever for well bore holes including a tubular mandrel adapted to be secured to the lower end of a tubular drill stem for lowering to the bottom of a well bore and having its bore communicating with the interior of the drill stem, an elongate cylindrical housing depending from the mandrel and having a tubular portion below its upper end to provide a downwardly opening cylindrical barrel of relatively large internal diameter, means rotatably connecting the housing to said mandrel, flow passage means in the upper end portion of said housing communicating with the bore of said mandrel and having at least one port extending from its lower end portion laterally outward through the wall of said housing at a tangent to its axis of rotation, whereby drilling fluid under pressure supplied to the flow passage means is discharged tangentially by its port into the well bore so as to impart rotation to said housing and centrifugal force to the discharged drilling fluid, elongated upright vane means within the barrel of said housing for creating a vortex therein upon rotation of said housing so as to draw debris from the bottom of the well bore through the downwardly opening lower end of said barrel, means within said barrel above its lower end for trapping large debris therein, and fluid passage means in said upper end portion of said housing above the discharge port therein establishing communication between the upper end of said barrel and said well bore to permit upward reverse circulation of said drilling fluid through said barrel.

2. A junk retriever as defined in claim 1 including teeth on the lower end of the barrel forming continuations of the vane means for cutting the bottom of the well bore upon rotation of the housing so as to loosen debris embedded therein.

3. A junk retriever as defined in claim 1 wherein the flow passage means in the upper end portion of the housing comprises an axial socket having the lower end of the mandrel rotatably confined therein.

4. A junk retriever as defined in claim 1 wherein the flow passage means communicating with the bore of the mandrel comprises an axial opening in the upper end portion of the housing having the lower end of said mandrel confined therein and a plurality of the tangential laterally outward extending discharge ports communicating with its lower end portion.

5. A junk retriever as defined in claim 1 including annular magnet means complementary to the cylindrical barrel of the housing and confined therein in engagement with its inner wall above the trapping means, the annular magnet means having a relatively narrow radial dimension so as to have a relatively large internal diameter.

6. A junk retriever as defined in claim 1 wherein the tangential laterally outward extending discharge port of the flow passage means has a downward inclination so as to swirl the drilling fluid downwardly and thereby increase the impetus of the vortex created by the vane means.

7. A junk retriever as defined in claim 6 wherein a plurality of the tangential laterally outward and downwardly extending ports is provided.

8. A junk retriever as defined in claim 1 wherein the inner cylindrical surface of the barrel has grooves extending axially thereof to form the vane means, the grooves increasing in depth downwardly of said barrel.

9. A junk retriever as defined in claim 1 wherein the vane means are formed in the bore of the barrel so as to be recessed therein.

* * * * *